United States Patent [19]

Batcheller

[11] 4,122,631

[45] Oct. 31, 1978

[54] PIPE RAIL AND GATE CONSTRUCTION

[75] Inventor: Roy W. Batcheller, South El Monte, Calif.

[73] Assignee: Crane-Veyor Corporation, South El Monte, Calif.

[21] Appl. No.: 810,309

[22] Filed: Jun. 27, 1977

[51] Int. Cl.[2] ..... E05B 65/06

[52] U.S. Cl. ..... 49/394; 49/386

[58] Field of Search ..... 49/394, 401, 381, 386; 256/21, 22, 24

[56] References Cited

U.S. PATENT DOCUMENTS

| | | | |
|---|---|---|---|
| 1,237,837 | 8/1917 | Sundh | 256/21 |
| 2,996,328 | 8/1961 | Killough | 49/394 X |
| 3,648,981 | 3/1972 | Allen | 256/24 |
| 3,706,164 | 12/1972 | Glause et al. | 49/394 |
| 3,903,567 | 9/1975 | Suska | 49/381 X |

*Primary Examiner*—Philip C. Kannan

[57] ABSTRACT

A pipe rail and gate system of uniform metal constituents and simple design utilizes extrusions to form accessory units such as hinges and stop plates to fit the pipe structure, the units being cut from the extruded sections. The shapes of the units and the expedients for fastening the units in place are blended in and function with the rail structure, outlines of the units and their working parts being confined within the dimensions of the rail structure with a minimum of protuberances.

9 Claims, 16 Drawing Figures

-30-

Fig. 4.
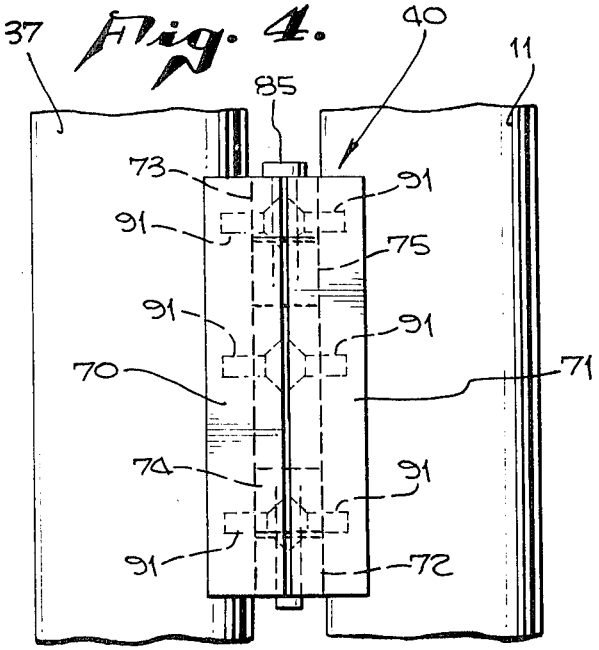
Fig. 3.
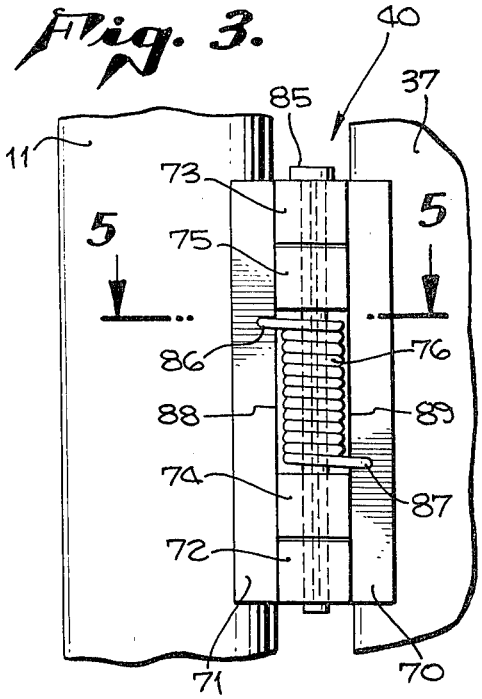
Fig. 5.
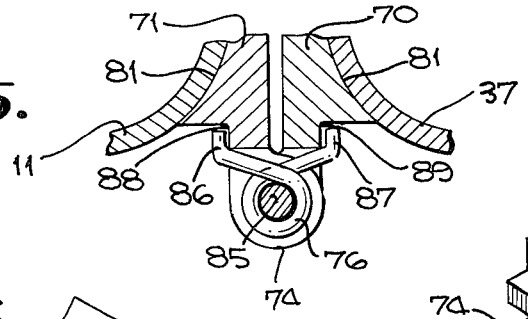
Fig. 7.
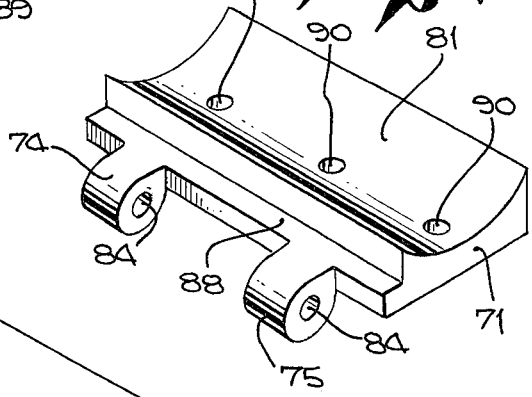
Fig. 6.
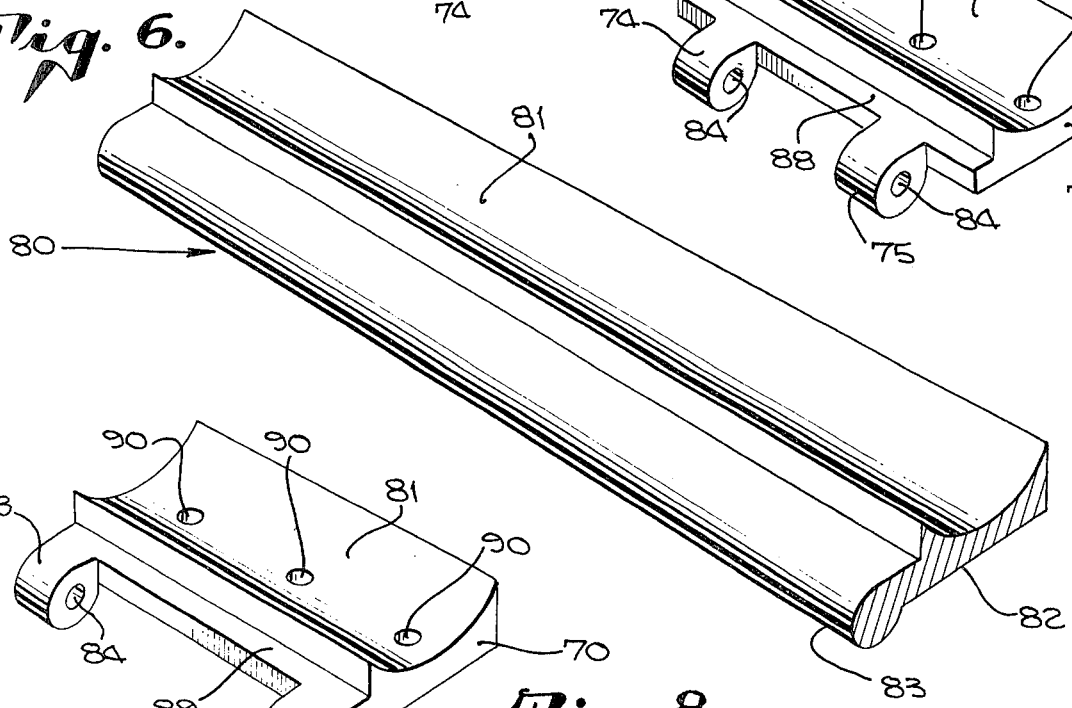
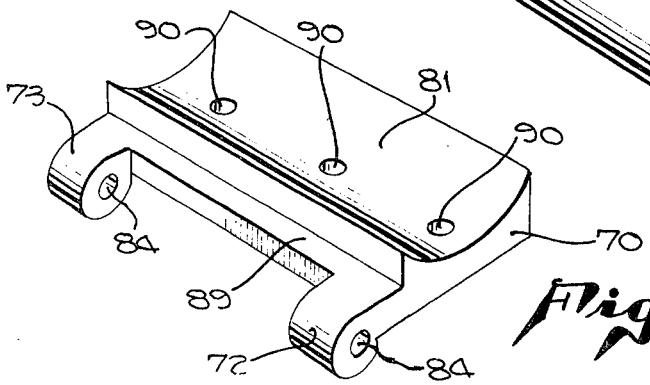
Fig. 8.

Fig. 9.
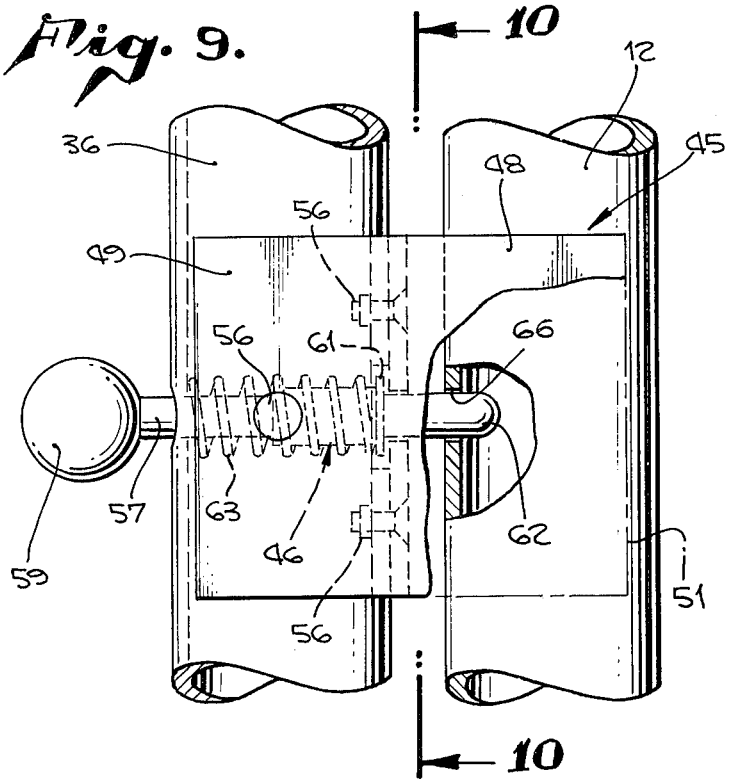
Fig. 10.
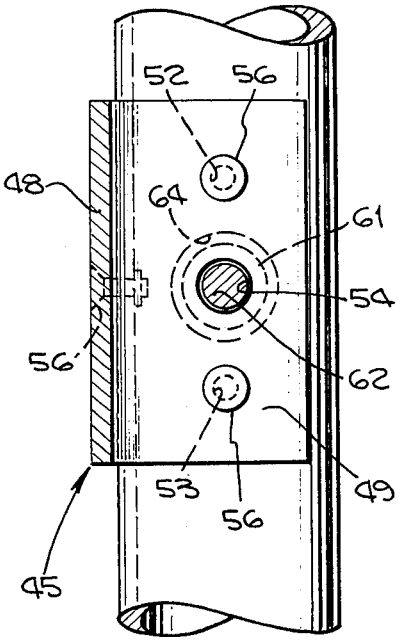
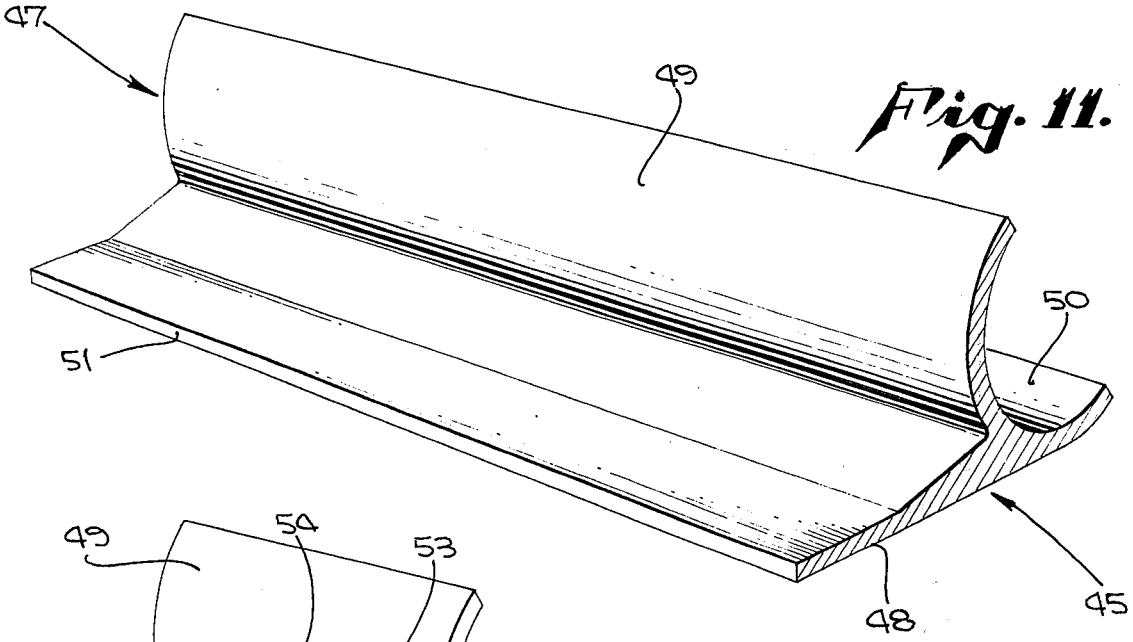
Fig. 11.
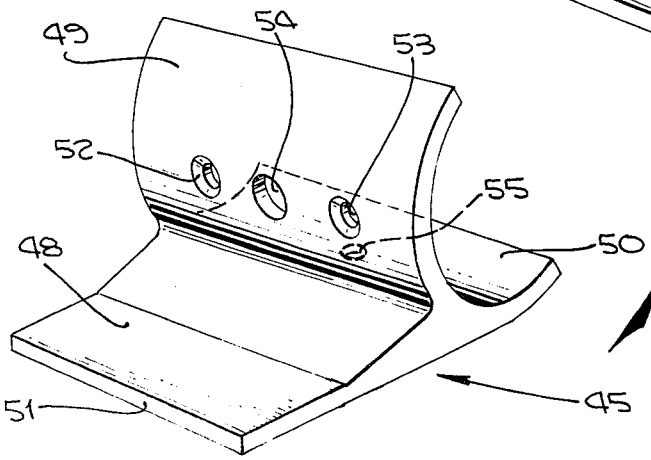
Fig. 12.

PIPE RAIL AND GATE CONSTRUCTION

For out of door and public areas pipe rail fences have been largely resorted to on balconies, platforms and stairways and the like. It is customary to prepare the fencing in sections with tubular rails joined to tubular posts with a neat smooth joint and then frequently to imbed the posts in concrete. To a large extent rails and posts have consisted of aluminum tubing because of the weather resistant character of the metal. The construction is customarily such that when all of the posts and tubes are cylindrical aluminum extrusions, the overall appearance, as well as the functional characteristics, present a neat, smooth, well-ordered appearance. As is commonly the case, a gate needs to be provided for closing the opening through the fence construction. Conventional hinges and latches suffer installation and performance problems when they are attached to gates and posts of tubular shape. Such conventional hinges and latches, when applied to an all over tubular construction, protrude unnecessarily and not only give the appearance of patchwork, but also involve protruding and sharp corners which are troublesome for occupants and also run the risk of catching and tearing clothes. Further still, when conventional hinges and latches initially designed for application to flat surfaces are attached to tubular surfaces, the attachment of such equipment becomes a problem and at times after they have been attached as well as possible, they ultimately become loose and insecure during use.

Therefore, it is among the objects of the invention to provide a new and improved pipe rail and gate construction in a pipe rail fence system where items such as hinges and latches are designed to fit properly with respect to the tubular rails so as to present a neat, clean and well-ordered appearance in the finished installation.

Another object of the invention is to provide a new and improved pipe rail and gate construction fence system wherein the latch bolt hardware can be made of extruded stock of substantially the same type of material as the tubular gate and fence construction itself, thereby not only to harmonize in appearance, but also to be capable of being easily and firmly secured in place.

Still another object of the invention is to provide a new and improved pipe rail and gate construction for a rail fence system wherein leaf hinges are made from stock which has been extruded in a shape corresponding to and fitting the tubular fence construction, as well as being made of substantially the same material, so that the hinge leaves fit the tubular members of gates and posts smoothly and comfortably, and which also can be fastened with a substantial degree of security so as to weather well when constantly exposed to the elements.

Still further among the objects of the invention is to provide a new and improved pipe rail and gate construction fence system wherein by making such accessory units as latch bolt assemblies and hinge assemblies from stock extruded in a shape to fit the tubular construction of the fencing, the accessory units can be attached quickly and easily to the tubular members even though access cannot be had to the tubular interiors, the attachment not only being secure from a utilitarian point of view, but also being neat and clean in appearance so as to enhance the overall appearance of the installation.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 3 is an elevational view of details of one of the hinge members taken from one side.

FIG. 4 is an elevational view of one of the hinge members taken from the opposite side.

FIG.5 is a fragmentary cross-sectional view on the line 5—5 of FIG. 3.

FIG. 6 is a perspective view of an extrusion from which hinge leaves are cut.

FIG. 7 is a perspective view of one of the leaf hinges of the hinge member.

FIG.8 is a perspective view of the other leaf of the hinge member.

FIG. 9 is an elevational view of the latch bolt member partially broken away.

FIG. 10 is a vertical sectional view on the line 10—10 of FIG. 9.

FIG. 11 is a perspective view of an extrusion from which essential sections of the latch bolt member are cut.

FIG. 12 is an elevational view of the latch bolt body which has been cut from the extrusion of FIG. 11.

Figure 1:
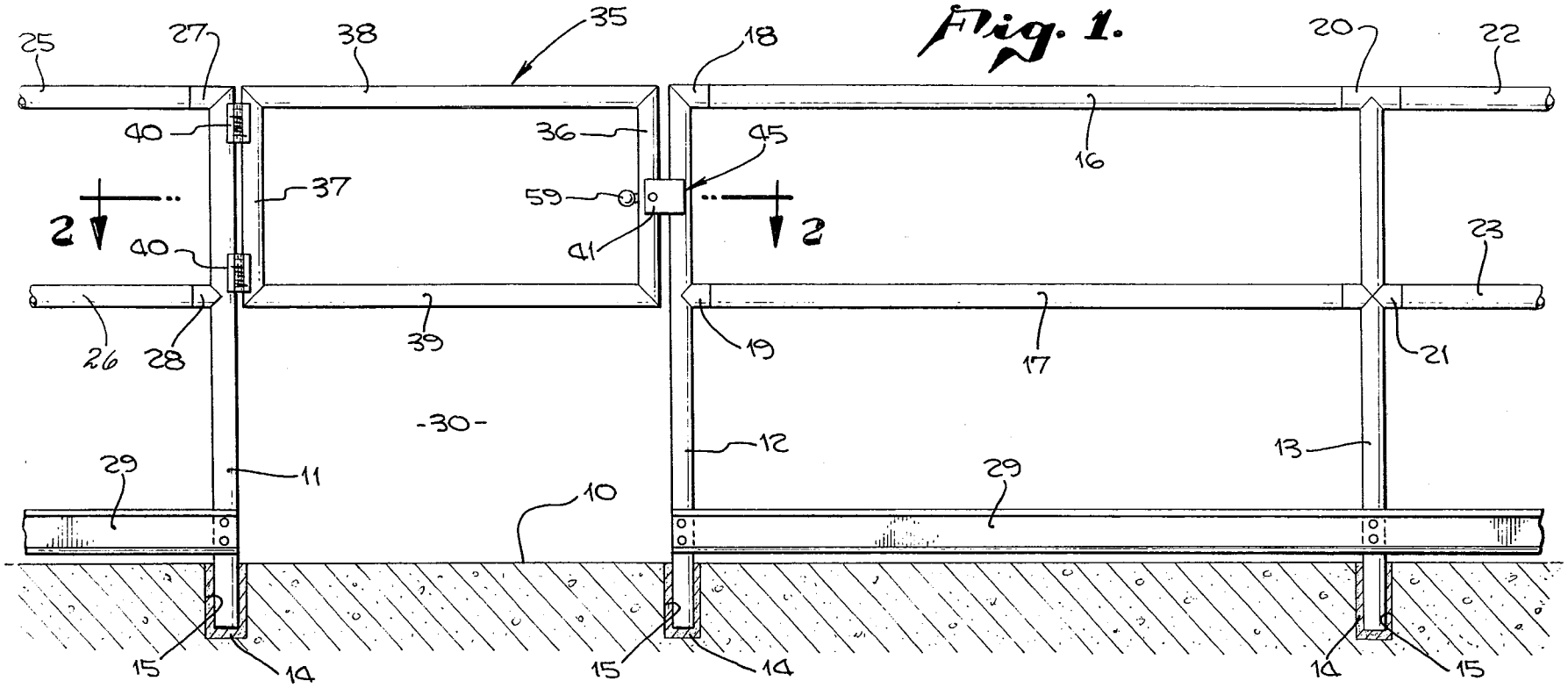
FIG. 1 is an elevational view of a fence installation showing posts, rails and gate construction mounted in place.

In an embodiment of the invention chosen for the purpose of illustration there is shown, for example, a supporting surface 10 which may be a platform or balcony in which is embedded tubular posts 11, 12 and 13, the tubular posts being set in conventional fashion by a grout 14 in holes 15. The tubular posts 11 and 12 define a doorway 30. Tubular rails 16 and 17 extend between respective posts 12 and 13, there being provided fittings 18 and 19, details of which are disclosed in U.S. Pat. No. 3,787,033, connecting the post 12 to rails 16 and 17. Fittings 20 and 21 attach the same tubular rails to the post 13. Similar rails 22 and 23 extend from the opposite side of the post 13 and correspondingly similar rails 25 and 26 are attached to the post 11 by fittings 27 and 28. A toe board extends from post to post immediately above the supporting surface 10.

To close the doorway between the posts 11 and 12 there is provided a substantially rectangular gate structure indicated generally by the reference character 35. The gate structure in the chosen embodiment consists of a pair of spaced parallel vertical tubular elements 36 and 37 to which is joined a pair of spaced parallel horizontal tubular elements 38 and 39 with mitered joints at the corners. The gate structure is swung by hinge members 40 attached respectively to the post 11 and tubular element 37. On the opposite side the gate structure is provided with a latch assembly 41 mounted on the vertical tubular element 36 of the gate structure and adapted to engage the post 12.

Figure 2:
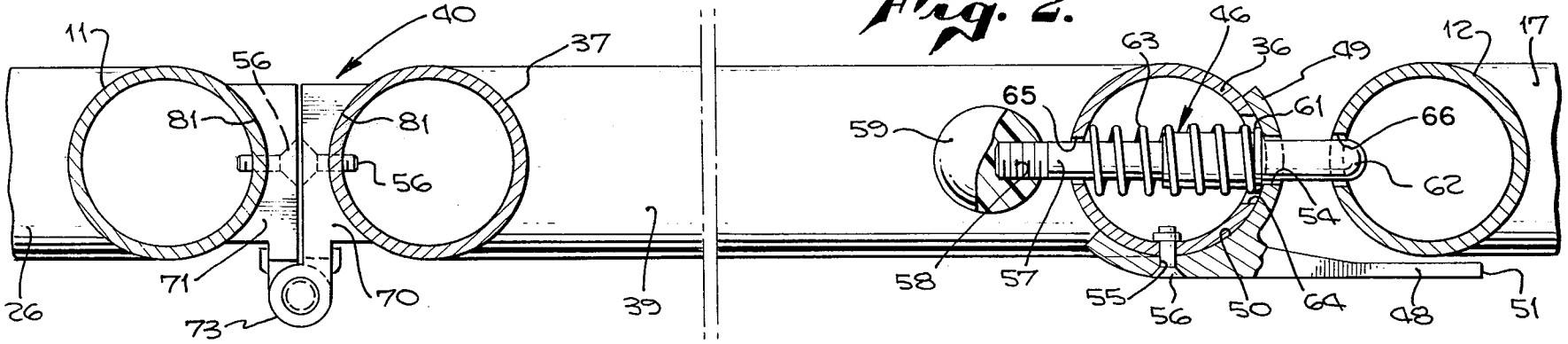
FIG.2 is a cross-sectional view on the line 2—2 of FIG. 1.
Figure 13:
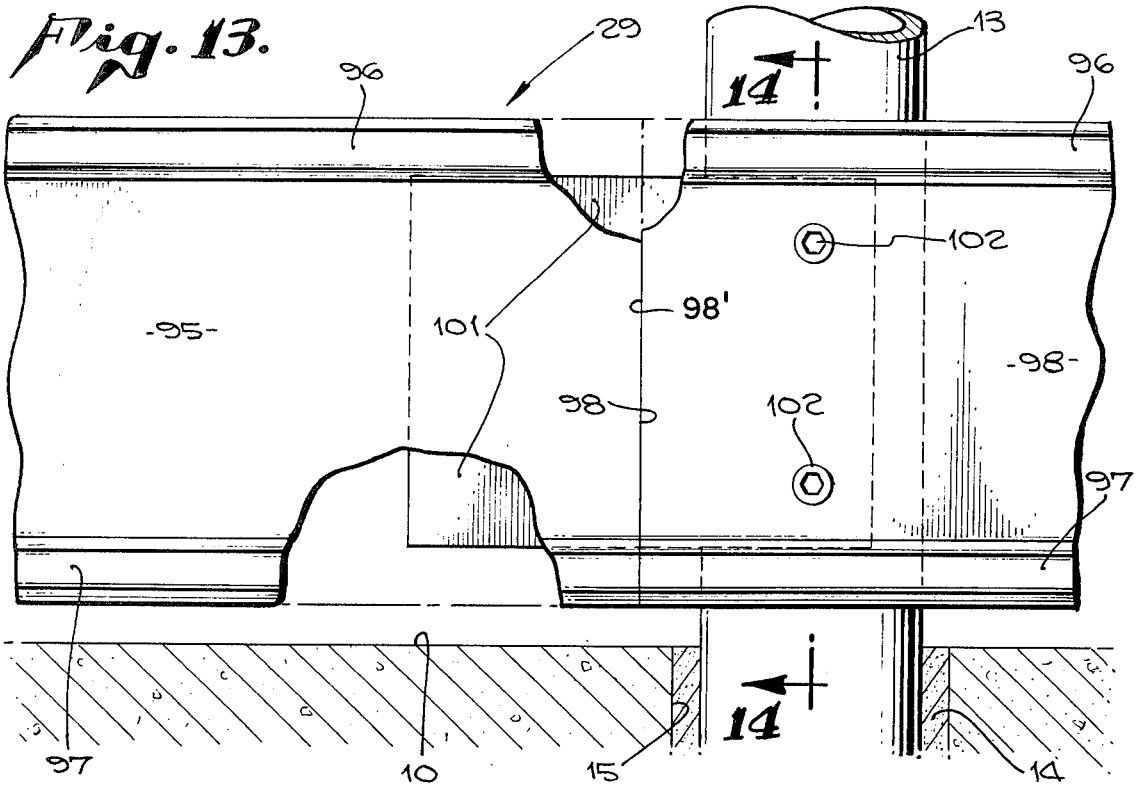
FIG. 13 is a fragmentary side elevational view of one of the posts showing a toe plate attached in place.

The latch assembly consists principally of two parts, namely a stop member 45 and a latch bolt 46, as shown in FIGS. 2, 9 and 10. To give the stop member shape, size and configuration, there is initially formed an extrusion 47, a section of which is shown in FIG. 11. It is advantageous to have the extrusion 47 of substantially the same metallic consistency as the posts and rails previously identified. From the extrusion 47 are cut sections of approximately the length shown in FIG. 12, and sections cut in that fashion become the stop member 45.

The extrusion 47 can obviously be virtually any practical length sufficient so that the stop member 45 can be cut to desired length as suggested in FIG. 12. The stop member is a multiple function piece consisting primarily of a stop plate 48 and an anchor member 49. The anchor member has an inside face 50, which is arcuate and has a curvature adapted to precisely fit the exterior of the tubular element 36. As can be seen in FIG. 2, the anchor member extends for a considerable distance around the circumference of the tubular member, actually almost 180°. At the location where the stop plate 48 joins the anchor member 49, the stop plate is slightly thicker, and shaped so that the thickness of the stop plate diminishes progressively from the captive end adjacent the anchor member 49 to the free end 51. Adjacent the junction of the stop plate 48 with the anchor member 49, the thickness of the anchor member is uniform as it extends around the exterior of the tubular member.

Virtually the only machining needed to complete the stop member after it has been cut from the extrusion 47 is to provide fastener holes 52 and 53 which are in axial alignment and an aperture 54, to accommodate the latch bolt 46. If desired, an additional fastener hole 55 may also be drilled.

Fasteners 56, which may be pull rivets, are employed to attach the stop member 45 to the tubular element 36. Pull rivets are especially advantageous because there is no ready access to the interior of the tubular element.

The latch bolt 46, previously identified, is of varying shape. A relatively small cylindrical portion 57 has threads 58 at one end to accommodate a knob 59. There is an adjacent relatively larger cylindrical portion 60 at the end of which is a radially outwardly extending circular flange 61 adjacent a projecting portion 62. A coil compression spring 63 bottoms at one end against the inside wall of the tubular element 36, the other end being kept by the flange 61. The spring, mounted as shown, is biased in a direction tending to project the latch bolt 46 into extended position as shown in FIG. 2.

In order to mount the latch bolt 46 in position, the knob is removed, the relatively small cylindrical portion is inserted through a large opening 64 and then extended through a relatively smaller opening 65, diametrically opposite, and with the spring in place. The knob can then be attached, and this is sufficient to lock the latch bolt in its reciprocating position. It will be noted that the circumference of the large opening 64 is somewhat larger than the outside diameter of the flange 61 and the spring 63, so that they are free to pass through the large opening 64. After this has been accomplished, the stop member 45 is applied and, by reason of the fact that the diameter of the aperture 54 in the anchor member 49 is smaller than the diameter of the flange 61, the anchor member becomes a stop for limiting outward motion of the latch bolt. An aperture 66 is provided in the adjacent tubular post 12, to receive the projecting portion 62 of the latch bolt in extended position as shown in FIG. 2. The latch bolt can be withdrawn from its latched position by merely pulling on the knob 59 to disengage the projecting portion 62 from the post 12. Furthermore, by having the stop plate 48 extend away from the anchor member a distance further than the projecting portion 62 of the latch bolt, the stop member will be assured of coming to a stop against the tubular post 12 whenever the gate structure 35 is closed. Also, the location of the aperture 54 has a built-in relation to the stop plate 48 and this assures that the latch bolt will operate properly with the projecting portion 62 entering the aperture 66 in the post 12 when the stop plate engages the post. The curved surface of the post 12 near the aperture 66 acts as a strike plate when engaged by the portion 62.

Each of the hinge members 40 previously made reference to consists of leaves 70 and 71 which have substantially identical shapes and differ only to the extent that knuckles 72 and 73 on the leaf 70 are spaced apart a distance greater than the spacing of knuckles 74 and 75 on the leaf 71. The knuckles 72 and 73 are actually flush with respective end edges of the leaf. Other faces of the respective knuckles 74 and 75 have a distance apart such that they fit snugly between inside faces of the knuckles 72 and 73. There does, however, remain a space between the inside faces of the knuckles 74 and 75. This space accommodates a torsion spring 76. Both of these are cut from an extrusion indicated generally by the reference character 80 and shown in perspective in FIG. 6. When the extrusion is made, there is an arcuate face 81 which has a curvature complementary to the curvature of the tube element 37 and the post 11. Since outside diameters of both these tubular elements are identical, the arcuate characters of the hinge leaves are also identical. Opposite the arcuate face 81 is a flat face 82. Extending along adjacent edges of the arcuate face 81 and flat face 82 is a bulbous flange 83 and it is from the bulbous flange 83 that the knuckles are made. This is accomplished primarily by milling out portions of the flange adjacent the knuckle locations. The knuckles are then drilled to provide bores 84 to accommodate a pintel 85.

When the hinge leaves are to be provided with a torsion spring 76, the spring is placed in the space between the knuckles 74 and 75 prior to driving the pintel into position. The spring has hooked ends 86 and 87 which engage over respective shoulders 88 and 89, the shoulders being the portion remaining of the bulbous flange 83 when the flange is milled out to provide the knuckles.

Appropriate fastener holes 90 are drilled in axial alignment on the respective leaves 70 and 71 for reception of appropriate fasteners such, for example, as pull rivets 91, which attach the leaf 70 to the post 11 and the leaf 71 to the tubular element 37. Because of the matching curvatures of the arcuate face 81 and the exterior of the tubular post or element, as the case may be, a single set of aligned fasteners is sufficient to securely anchor the hinge leaf in place.

Figure 14:
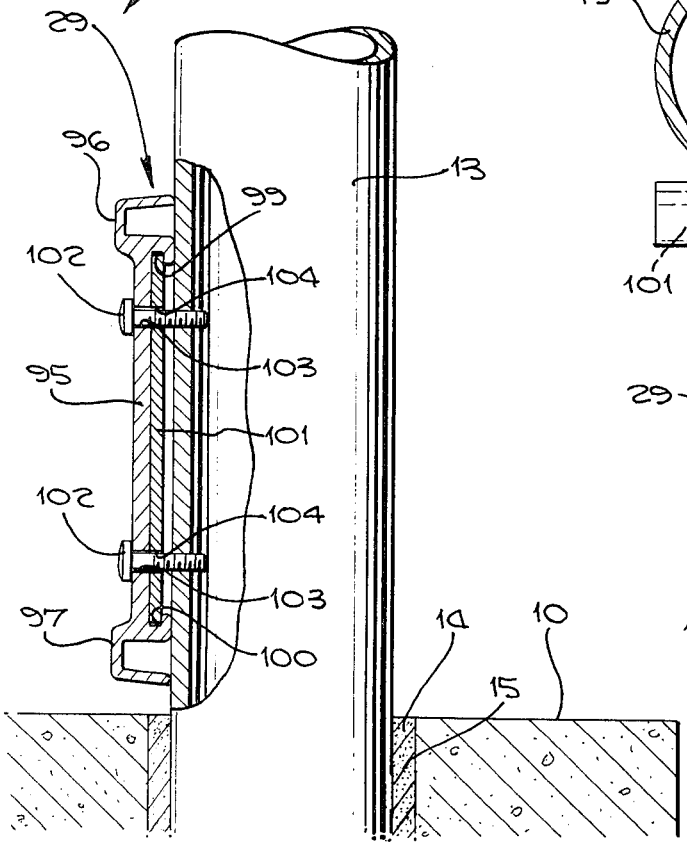
FIG. 14 is a vertical fragmentary sectional view on the line 14—14 of FIG. 13.

On occasions when the pipe rail and gate construction is to be used on a platform or balcony, or even on a stairway, it is highly advantageous to provide the previously described toe board 29. The toe board is preferably also an extrusion, consisting of a center plate 95 and edge ribs 96 and 97. To effectively join adjacent ends 98 and 98' to toe boards 29, the toe board is extruded to provide undercut channels 99 and 100. These, of course, can be milled for the full length of the toe board, whatever the length, so as to be available wherever the toe board chances to be cut in order to fit a given installation. A connector plate 101 is made just wide enough to fit into the oppositely disposed channels 99 and 100, as shown in FIG. 14 to strengthen the joint. An effective joint is one made in the vicinity of one of the posts 13 so that self-threading screws 102 can be driven through fastener holes 103 in the toe board and also similar fastener holes 104 in the connector plate 101 before the fastener screws thread their way into the post 13.

Figure 15:
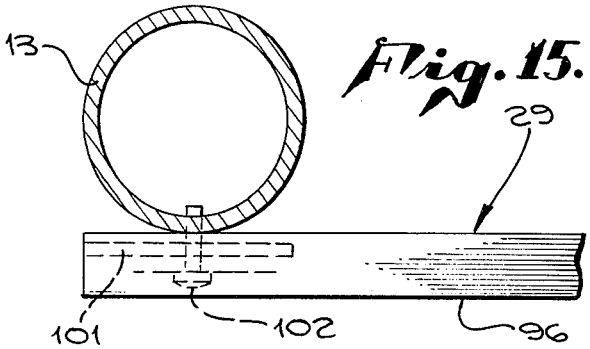
FIG. 15 is a fragmentary cross-sectional view of one of the posts showing a toe plate attached.
Figure 16:
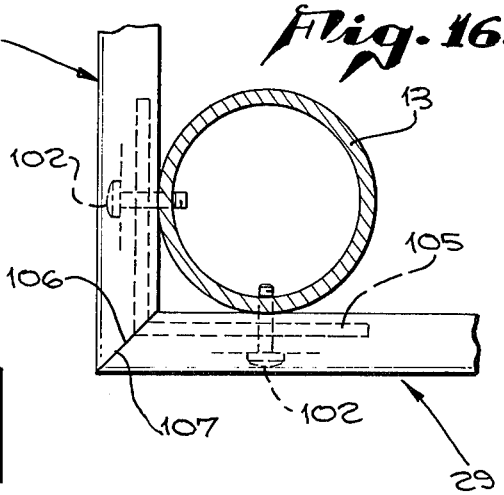
FIG. 16 is a fragmentary cross-sectional view of a corner post with toe plate attached.

Further still, in a right angular junction at a corner as shown in FIG. 16, a corner connector plate 105, initially bent at a right angle, may be employed and respective ends 106 and 107 of adjacent toe boards mitered to provide a neat fitting corner before the toe boards are slid into place over the corresponding ends of the corner connector plate 105. It is also advisable to use a short piece of connector plate 101 for an end connection of a toe board 29 to a post 13 as shown in FIG. 15.

Having described the invention, what is claimed as new in support of Letters Patent is as follows:

1. In a gate construction comprising a frame for a doorway including a cylindrical tubular post, a gate structure swingably mounted on said frame comprising a vertical tubular member on the side adjacent said post, and a latch assembly for the gate structure on the side adjacent said post, said latch assembly comprising a stop member and a latch bolt, said stop member comprising an anchor plate having an extruded arcuate shaped surface corresponding to the arcuate exterior of the respective tubular member and a stop plate extending tangentially from said anchor plate and outwardly relative to the gate structure, fastening means acting between the anchor plate and the corresponding tubular member for holding the stop member in place, means forming holes respectively in said tubular member and said post with the arcuate exterior of said post adjacent the hole therein serving as a strike, said latch bolt being spring actuated and extending slidably through the hole in the tubular member and adapted to extend into the hole in the adjacent post for holding the gate in closed position.

2. A gate construction as in claim 1 wherein the anchor plate of the stop member extends around the respective tubular member to a location in diametrical alignment with said latch bolt, there being diametrically aligned holes in said tubular member, said anchor plate and said adjacent post for reception of said latch bolt.

3. A gate structure as in claim 2 wherein said stop plate lies substantially in the plane of the adjacent side of the gate structure when the stop member is in fastened position on said gate structure.

4. A gate structure as in claim 2 wherein the thickness of the stop plate increases progressively in a direction from a free edge thereof to a line of tangency with the anchor plate.

5. A gate construction as in claim 1 wherein there is a coiled compression spring around said latch bolt acting between the corresponding tubular member on the inside wall and the latch bolt in a direction biasing said latch bolt to extended position.

6. A gate construction as in claim 5 wherein said latch bolt has a radially outwardly extending flange integrally formed in the latch bolt acting with said spring as a spring keeper.

7. A gate structure as in claim 1 wherein there is a single line of fasteners on a line intermediate opposite edges of anchor plate for mounting said stop member on the respective tubular member.

8. In a gate construction comprising a plurality of vertical tubular posts in parallel spaced relationship wherein two of said tubular posts serve as frame members for a doorway and tubular rails are attached to said tubular posts defining a fence, a substantially rectangular gate structure for said doorway comprising parallel spaced vertical tubular members and parallel spaced horizontai tubular members joined thereto at respective corners of the gate structure, a plurality of hinge members comprising opposite complementary leaves consisting of sections of an extruded strip of material corresponding to the material of said tubular members, one face of each hinge member having an extruded arcuate shaped surface complementary to the arcuate exterior of the tubular post and the opposite face being flat, complementary pivotally joined knuckles on adjacent edges of said leaves, and fastening means between the adjacent post and the corresponding leaf of the hinge member, and a latch assembly for the gate on the side opposte said hinge members, said latch assembly comprising a stop member and a latch bolt, said stop member comprising an anchor plate having an extruded arcuate shaped surface corresponding to the arcuate exterior of the respective tubular members and a stop plate extending tangentially from said anchor plate and outwardly relative to the gate structure, fastening means acting between the anchor plate and the corresponding tubular member for holding the stop member in place, said latch bolt being spring actuated and extending slidably through the tubular member adjacent the plate and into the adjacent post on the corresponding side of the doorway, said latch bolt being reciprocatable into and out of engagement with the adjacent post.

9. A gate structure as in claim 8 wherein each hinge member has a first pair of knuckles spaced from each other on one edge of one of said leaves, and a second pair of knuckles on one edge of the other of said leaves spaced respectively inwardly from the first identified knuckles, there being a space between the second pair of knuckles, and a pintle extending through all said knuckles.

* * * * *